US007926228B1

(12) United States Patent
Snow

(10) Patent No.: US 7,926,228 B1
(45) Date of Patent: Apr. 19, 2011

(54) CREMATION NICHE

(76) Inventor: William L. Snow, Anna Maria, FL (US)

( * ) Notice: Subject to any disclaimer, the term of this patent is extended or adjusted under 35 U.S.C. 154(b) by 0 days.

(21) Appl. No.: 12/868,168

(22) Filed: Oct. 8, 2010

(51) Int. Cl.
*E04H 13/00* (2006.01)

(52) U.S. Cl. ..... 52/136; 52/128; 52/137; 27/35

(58) Field of Classification Search ..... 52/128, 52/134, 136, 137, 139, 140; 312/107, 108, 312/111, 198; 27/1, 35
See application file for complete search history.

(56) References Cited

U.S. PATENT DOCUMENTS

| | | | | | |
|---|---|---|---|---|---|
| 278,354 | A | * | 5/1883 | Miller | 292/80 |
| 1,742,141 | A | * | 12/1929 | Hicks | 312/111 |
| 1,752,572 | A | * | 4/1930 | Person | 52/134 |
| 1,989,289 | A | * | 1/1935 | Piazza | 52/506.09 |
| 2,525,017 | A | * | 10/1950 | Cheek et al. | 52/136 |
| 2,593,998 | A | * | 4/1952 | Dupuis | 206/509 |
| 2,618,145 | A | * | 11/1952 | Sinner et al. | 52/509 |
| 2,814,942 | A | * | 12/1957 | Sinner et al. | 52/509 |
| 2,828,062 | A | * | 3/1958 | Fellowes | 206/511 |
| 3,076,292 | A | * | 2/1963 | Arbogast | 52/136 |
| 3,084,985 | A | * | 4/1963 | Bergman | 312/111 |
| 3,287,865 | A | * | 11/1966 | Lockman | 52/136 |
| 3,529,730 | A | * | 9/1970 | Thompson | 211/85.27 |
| 3,754,805 | A | * | 8/1973 | Pangburn et al. | 312/111 |
| 3,759,003 | A | * | 9/1973 | Wilson | 52/285.4 |
| 3,888,055 | A | * | 6/1975 | Gallo | 52/98 |
| 3,925,944 | A | * | 12/1975 | Pickel | 52/134 |
| 3,983,667 | A | * | 10/1976 | Zwick | 52/140 |
| 3,990,199 | A | * | 11/1976 | Gallo | 52/137 |
| 4,073,100 | A | * | 2/1978 | DiGiovanni, Jr. | 52/79.3 |
| 4,107,887 | A | * | 8/1978 | Wendt | 52/105 |
| 4,476,657 | A | * | 10/1984 | Juba et al. | 52/139 |
| 5,265,396 | A | * | 11/1993 | Amimoto | 52/745.12 |
| 5,287,603 | A | * | 2/1994 | Schorman | 27/1 |
| 5,419,091 | A | * | 5/1995 | Roberts | 52/509 |
| 5,477,594 | A | * | 12/1995 | LePage | 27/1 |
| 5,740,637 | A | | 4/1998 | Snow | |
| 5,765,269 | A | | 6/1998 | Zarth | |
| 5,894,699 | A | * | 4/1999 | Fulton et al. | 52/132 |
| 5,979,124 | A | | 11/1999 | Branan | |
| 6,098,350 | A | | 8/2000 | Kochtitzky | |
| 6,105,315 | A | | 8/2000 | Stoecklein et al. | |
| 6,250,025 | B1 | | 6/2001 | Darby | |
| 6,347,439 | B1 | | 2/2002 | Bach Lahor | |
| 6,370,745 | B1 | | 4/2002 | Kele et al. | |
| D467,700 | S | | 12/2002 | Spencer | |
| D471,342 | S | | 3/2003 | Spencer | |
| 6,578,323 | B1 | | 6/2003 | Zartman et al. | |
| 6,904,721 | B1 | | 6/2005 | Forbes | |
| 7,171,733 | B2 | | 2/2007 | Min | |
| 7,243,405 | B1 | | 7/2007 | Green | |
| 7,287,306 | B1 | | 10/2007 | Green | |
| 7,415,800 | B2 | | 8/2008 | Stienwand | |
| 7,591,053 | B2 | | 9/2009 | Bosisio et al. | |
| 7,739,776 | B2 | * | 6/2010 | Hume | 27/35 |
| 2002/0144472 | A1 | | 10/2002 | Chafer | |

* cited by examiner

*Primary Examiner* — Robert J Canfield
*Assistant Examiner* — Charissa Ahmad
(74) *Attorney, Agent, or Firm* — Charles J. Prescott

(57) ABSTRACT

A cremation niche including a concrete masonry block formed as a single unit having an uninterrupted cross section which includes rectangular sides, top and bottom panels and open rectangular front and rear openings providing access into a hollow horizontally disposed interior of the concrete block. The concrete block material consistency and overall outside dimensions are equal to those of a conventional concrete building block. A plastic liner having an open front is snugly fit within and mating against inner surfaces of the concrete block which define the interior. A decorative faceplate covers the front opening, mating with the front surface and against a perimeter of the front opening of the liner.

4 Claims, 9 Drawing Sheets

CREMATION NICHE

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to cremation niches, and particularly to a cremation niche having an improved concrete building block configuration of uniform size and fabrication and having a completely open ended interior for ease of manufacture and economy.

2. Description of Related Art

Cremation has become an increasingly popular burial means for human and animal remains. Popularity is increasing as the cost of conventional funerals and burial property dramatically increases. Cremation internment typically involves the storage of a relatively small volume of finely ground ash produced during the cremation process. Although disposal of cremation ash is also quite popular wherein the ash is spread over a particular area, terrain or at sea, nonetheless retaining the cremated remains for various reasons is also quite popular.

Although one storage means for cremation ash is within a portable urn, cremation niches used in a crypt or mausoleum to form, or be positioned against a vertical wall add further dignity to the cremation internment process. In my previous patent, I utilized a well-known building block structure in the form of a concrete building block or cinderblock formed of cured aggregate concrete material having a size and shape of a conventional concrete building block. Each niche, formed to include one of these concrete blocks, was then used to form an entire display wall within a crematorium or the like. However, the manufacturer of the concrete block with a closed end cavity as best seen in FIG. 2 of U.S. Pat. No. 5,740,637 was found to be uneconomical to manufacture.

U.S. Pat. No. 7,287,306 to Green discloses a device for storing remains. Kele et al. teaches a burial crypt arrangement in U.S. Pat. No. 6,370,745. A self-mountable niche for remains ashes is disclosed by Bach Lahor in U.S. Pat. No. 6,347,439. Zartman et al. teach a columbarium and niche unit therefor in U.S. Pat. No. 6,578,323.

The present invention provides an improved concrete block structure utilized to form a cremation niche. This improved concrete block has only parallel side, top and bottom walls, the front and back walls being completely open to define a completely open ended interior thereof. However, the benefits of forming such an improved concrete block having the same size and shape as that of a conventional concrete building block have been retained, the improvement affording substantial decreases in the cost of manufacture. Because of the completely open interior, it is preferred that this improved cremation niche be utilized to form a bank of niches against a support wall which is preferably formed of the same improved concrete block structure.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to a cremation niche including a concrete masonry block formed as a single unit having an uninterrupted cross section which includes only rectangular sides, top and bottom panels with open rectangular front and rear openings providing access into a hollow horizontally disposed interior of the concrete block. The concrete block material consistency and overall outside dimensions are equal to those of a conventional concrete building block. A niche liner having an open front is preferably snugly fit within and mating against inner surfaces of the concrete block which define the interior. A decorative faceplate covers the front opening, mating with the front surface and against a perimeter of the front opening of the niche liner.

It is therefore an object of this invention to provide a cremation niche formed from a uniquely configured concrete building block or "cinderblock" structure absent any front or back walls so as to define an economically manufacturable concrete block structure.

Still another object is to provide a concrete block for a cremation niche which has only outer symmetric walls and an open-ended interior and which may be used to form a support wall against which a bank of cremation niches may be installed.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Figure 1:
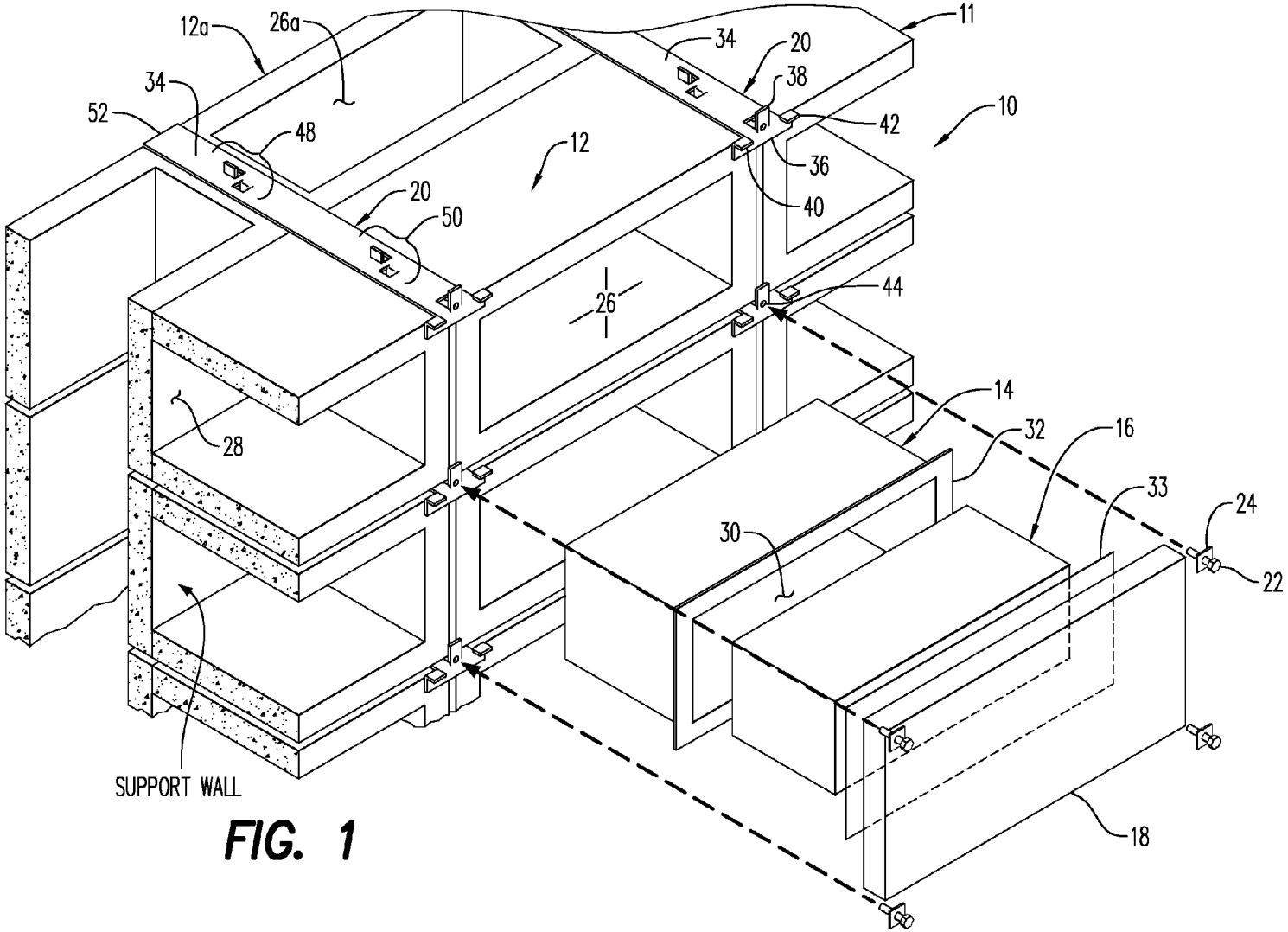
FIG. 1 is an exploded perspective view of one embodiment of a cremation niche system having a single bank of cremation niches.

Exemplary embodiments are illustrated in reference figures of the drawings. It is intended that the embodiments and figures disclosed herein are to be considered to be illustrative rather than limiting.

DETAILED DESCRIPTION OF THE INVENTION

List of Components

10. cremation niche system 10'. double cremation niche system
11. first bank of cremation niches
12. precast concrete block
13. second bank of cremation niches
14. niche liner
16. urn
18. faceplate
20. faceplate support strap
20*a*. support strap blank
20'. double faceplate support strap
22. faceplate attaching bolt
24. rosette
26. concrete block interior
28. support wall upright side
30. liner interior
32. liner mounting flange
33. cover plate
34. flat bar
36. upright lower stop
38. upright upper stop
40. faceplate support
42. faceplate support
44. bolthole
46. upper stop cutout
48. block alignment tab pair
50. block alignment tab pair
52. bar end
54. block alignment tab pair
56. block alignment tab pair
58. block alignment tab pair Referring now to the drawings, and firstly to FIGS. 1 to 7, one embodiment of the invention is there shown generally at numeral 10 and includes a plurality of precast concrete blocks 12 formed by the same process and having exactly the same dimensions and material consistency and content as that of a conventional concrete building block or "cinderblock" used in building construction. The concrete block 12 thus generally has nominal overall dimensions of 8"×8"×16" or 8"×16"×16". Moreover, the manufacturing process of the concrete block 12 is the same process as that used for the concrete building blocks for both economy and rapidity of production.

Each concrete block 12 is formed having side, top and bottom walls defining an interior 26 which is hollow and open at each end thereof. Moreover, this structure may be viewed as being symmetric. A molded, preferably plastic niche liner 14 closely mates against all of the interior wall surfaces of cavity 26 and defines an interior 30 having a rectangular opening at one end thereof and enclosed bottom and side walls which define the interior 30. A liner mounting flange 32 mates against the front surface of the concrete block 12 and defines a perimeter of the niche liner 14. A sealed urn 16 formed of any suitable material such as stainless steel, plastic, or wood which contains cremated remains, the urn 16 being sized to fit within the interior 30 of the niche liner 14.

Figure 2:
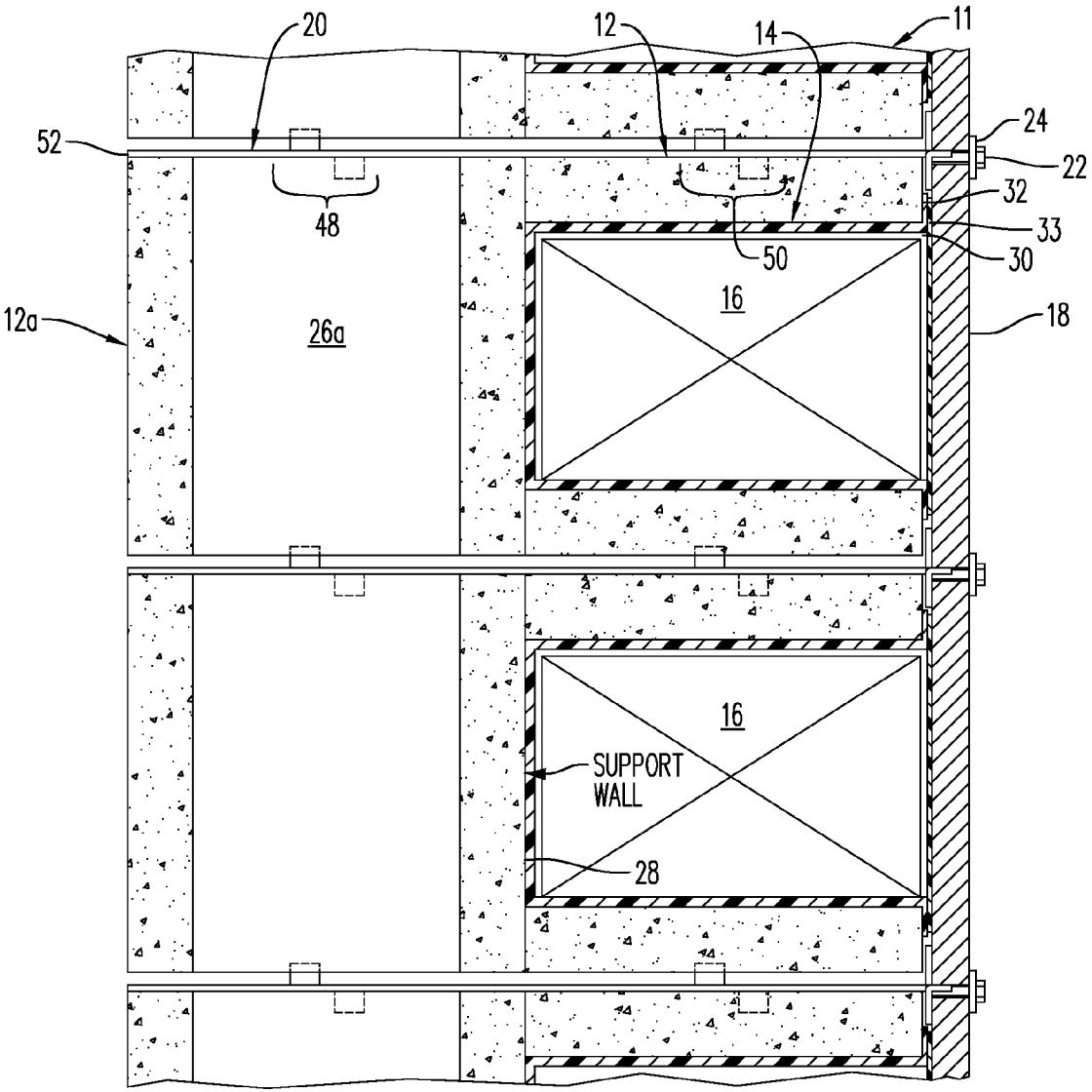
FIG. 2 is a vertical section view of FIG. 1.
Figure 3:
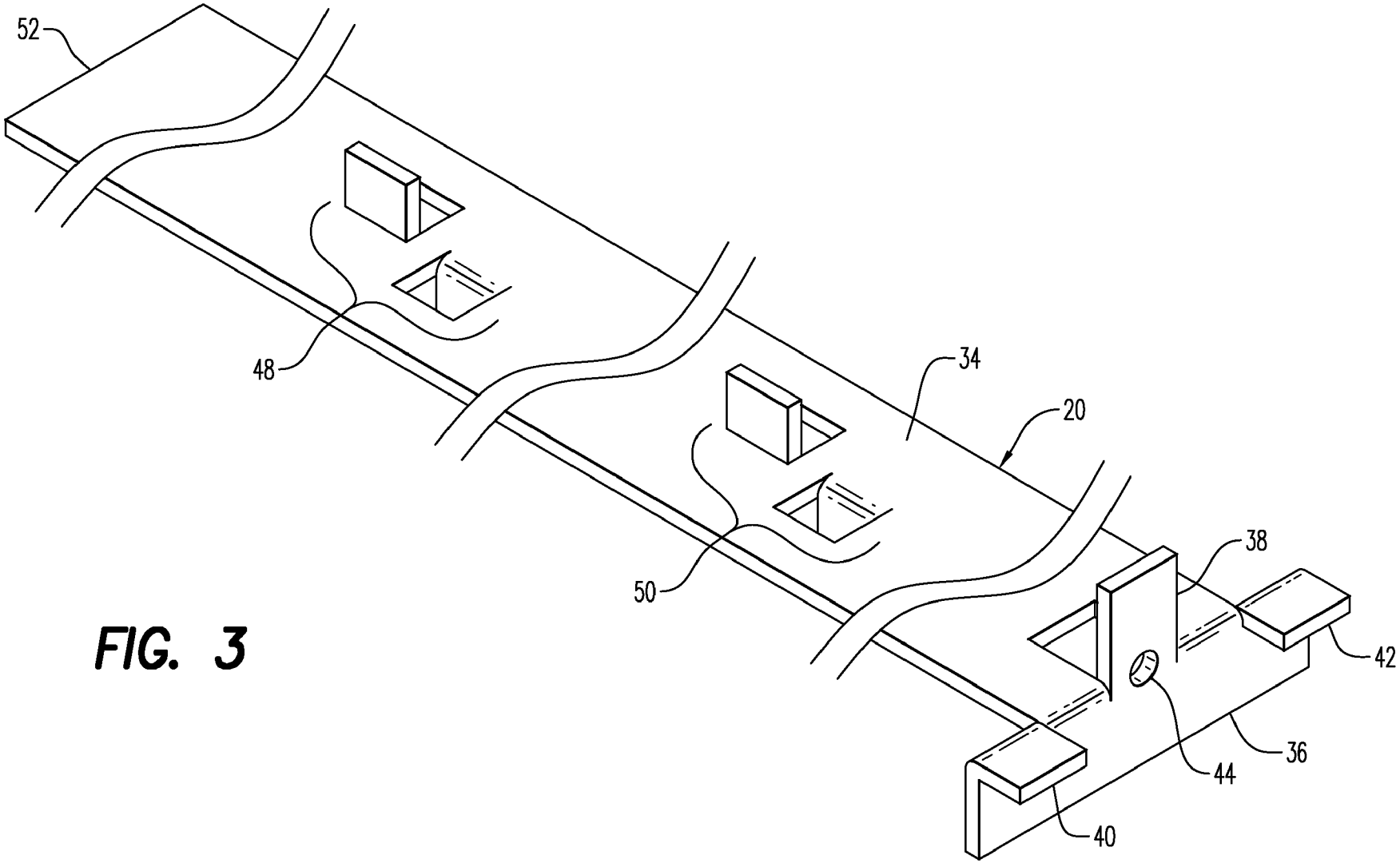
FIG. 3 is a perspective view of a faceplate support strap.
Figure 4:
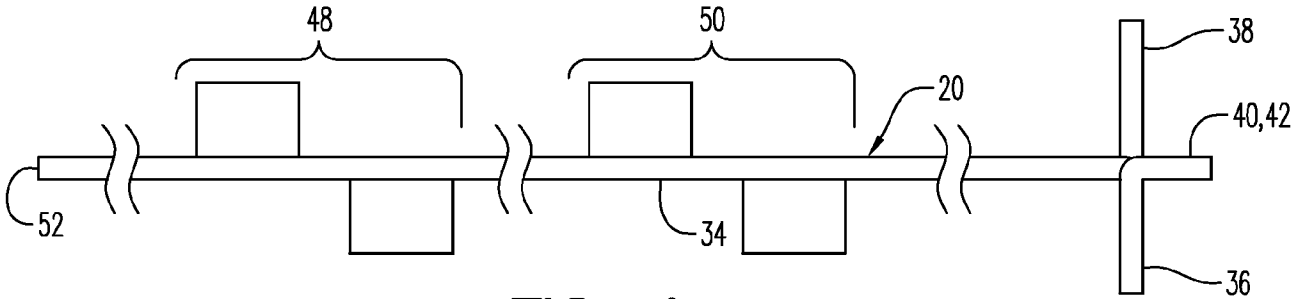
FIGS. 4, 5 and 6 are orthogonal side plan and end views, respectively, of FIG. 3.
Figure 5:
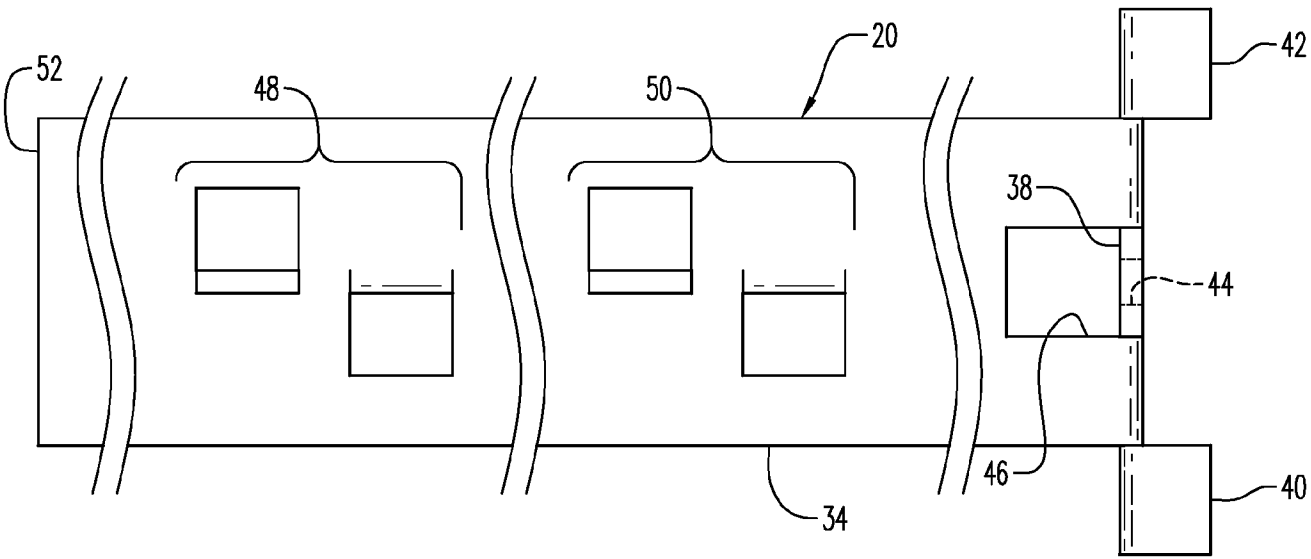
Figure 6:
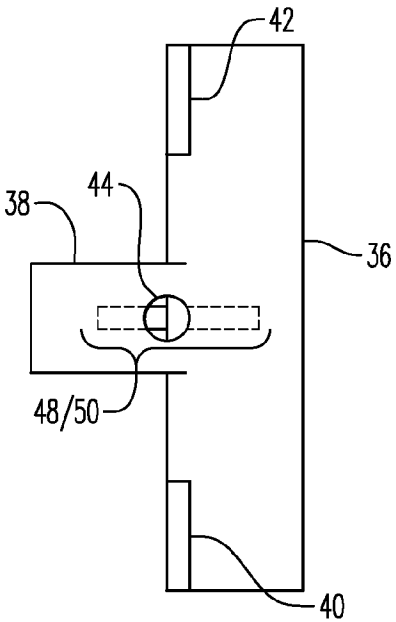
Figure 7:
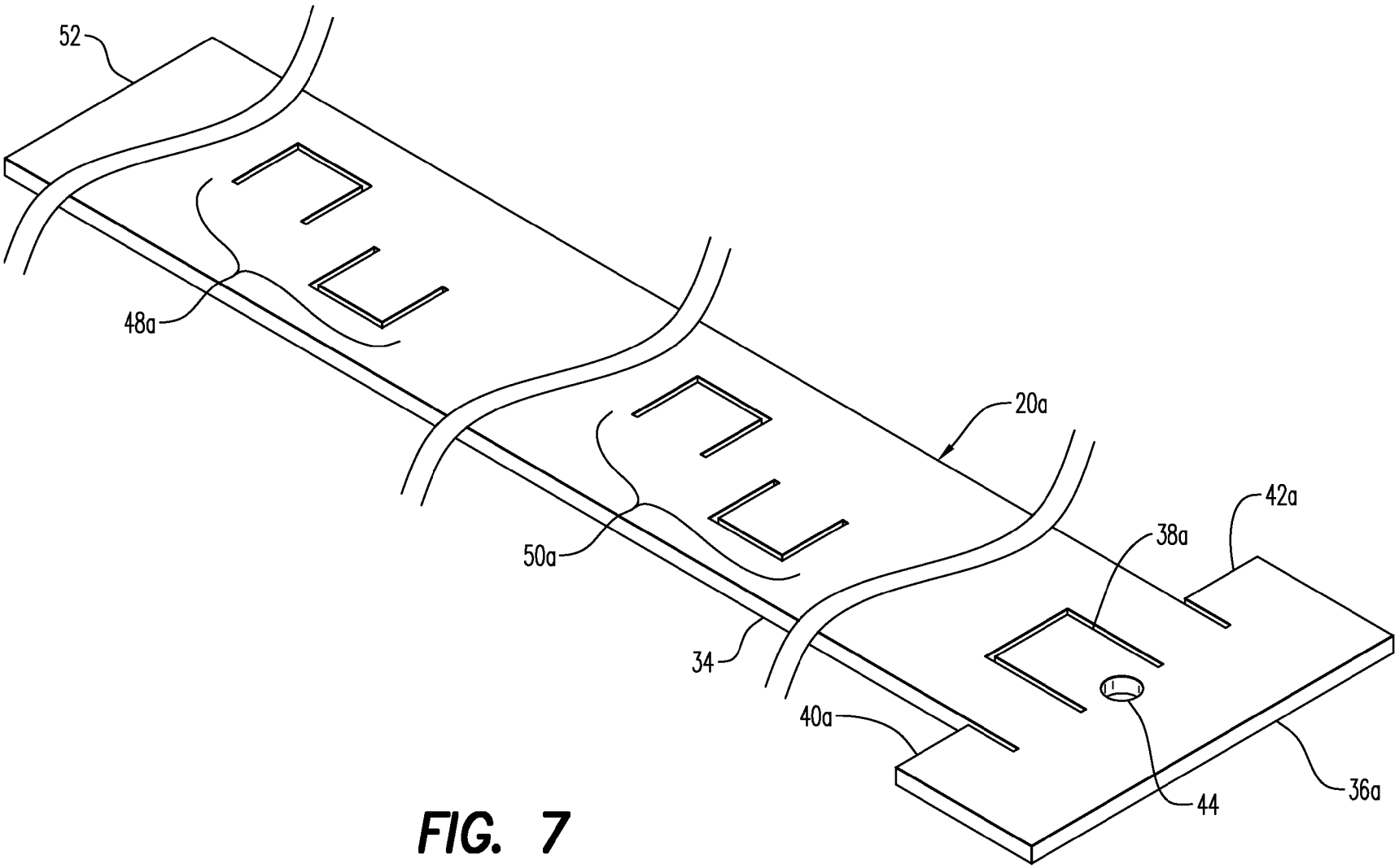
FIG. 7 is a perspective view of the support strap blank of FIG. 3.

In this embodiment 10, a single column or bank 11 of concrete blocks 12 are stacked vertically and in vertical alignment one block atop another with adjacent columns of aligned blocks 12 in horizontal alignment one column to the next to form the bank 11 of cremation niches. As previously described, each of the concrete blocks 12 is open at each end of the interior 26 so as to be substantially symmetric in both vertical and horizontal cross section. A support wall is formed of concrete block 12*a* which are identical to the concrete blocks 12 except for the vertical orientation of the interior 26*a*. The concrete blocks 12*a* of the support wall are stacked in horizontal alignment with the concrete blocks 12 as best seen in FIGS. 1 and 2. In order to establish a proper vertical spacing between each row of concrete blocks 12 and 12*a*, an elongated faceplate support strap 20 formed of a flat aluminum or stainless steel bar best seen in FIG. 7 is provided. Each of these faceplate support straps 20 include pairs of opposingly vertically oriented block alignment tab pairs 48 and 50. These alignment tab pairs 48 and 50 are centered along the longitudinal center line of the faceplate support strap 20 and, as best seen in FIGS. 1 and 2, provide horizontal alignment between each horizontally adjacent concrete block 12 of the bank 11 of niches and each concrete block 12*a* of the support wall. One end of the faceplate support strap 20 also includes an upwardly extending upright upper stop 38 and a downwardly extending upright lower stop 36. These stops 36 and 38 simultaneously bear against the front surface of a total of four concrete blocks 12 along the "quadraedge" formed by each group of four blocks.

The formed end of the faceplate support strap 20 also includes outwardly extending faceplate supports 40 and 42 which are coplanar with the flat bar 34 and serve to align and support two adjacent faceplates 18 which are preferably formed of granite material and provide an exposed surface for identifying the cremation remains of the deceased and other visual memorabilia to enhance the ceremonial aspects of each of the niches.

In order to retain the faceplates in place after niche liners 14 have been inserted into the interior 26 and the urn 16 has been placed into the interior 30 of the niche liner 14, a flat plastic cover plate 33 sized in length and width to substantially equal that of the liner mounting flange 32 and the overall vertical and horizontal dimensions of each concrete block 12, will seal and protect the urn 16 positioned within the interior 30 of the niche liner 14. Thereafter, the faceplate 18 will be positioned against the cover plate 33 resting on the corresponding faceplate support 40 or 42.

To secure each of the faceplates 18 in place, a combination mechanical fastener 22 and enlarged rosette 24 are threadable engaged into an aperture 44 positioned centrally at the base of upright upper stop 38. The rosette 24 is sufficiently large to overlap and cover the quadraedge intersection of the four corners of the respective faceplates 18. The overall length of each of the flat bars 34 of the faceplate support strap 20 is generally equal to the thickness of two of the concrete blocks 12 and 12*a* (16") so that the opposite end 52 is generally in alignment with the back surface of the concrete blocks 12*a* of the support wall.

Referring now to FIGS. 8 to 12, a second embodiment of the invention is there shown generally at numeral 10' and includes a plurality of the precast concrete blocks 12 as previously described. However, in this embodiment 10', two outwardly facing banks of cremation niches 11 and 13 are provided. Each of these niche banks 11 and 13 outwardly extend from the common support wall and are positioned and attached against upright wall surfaces 28 and 28*a*, respectively. All identically numbered features as previously described are also provided in this embodiment 10'.

Figure 8:
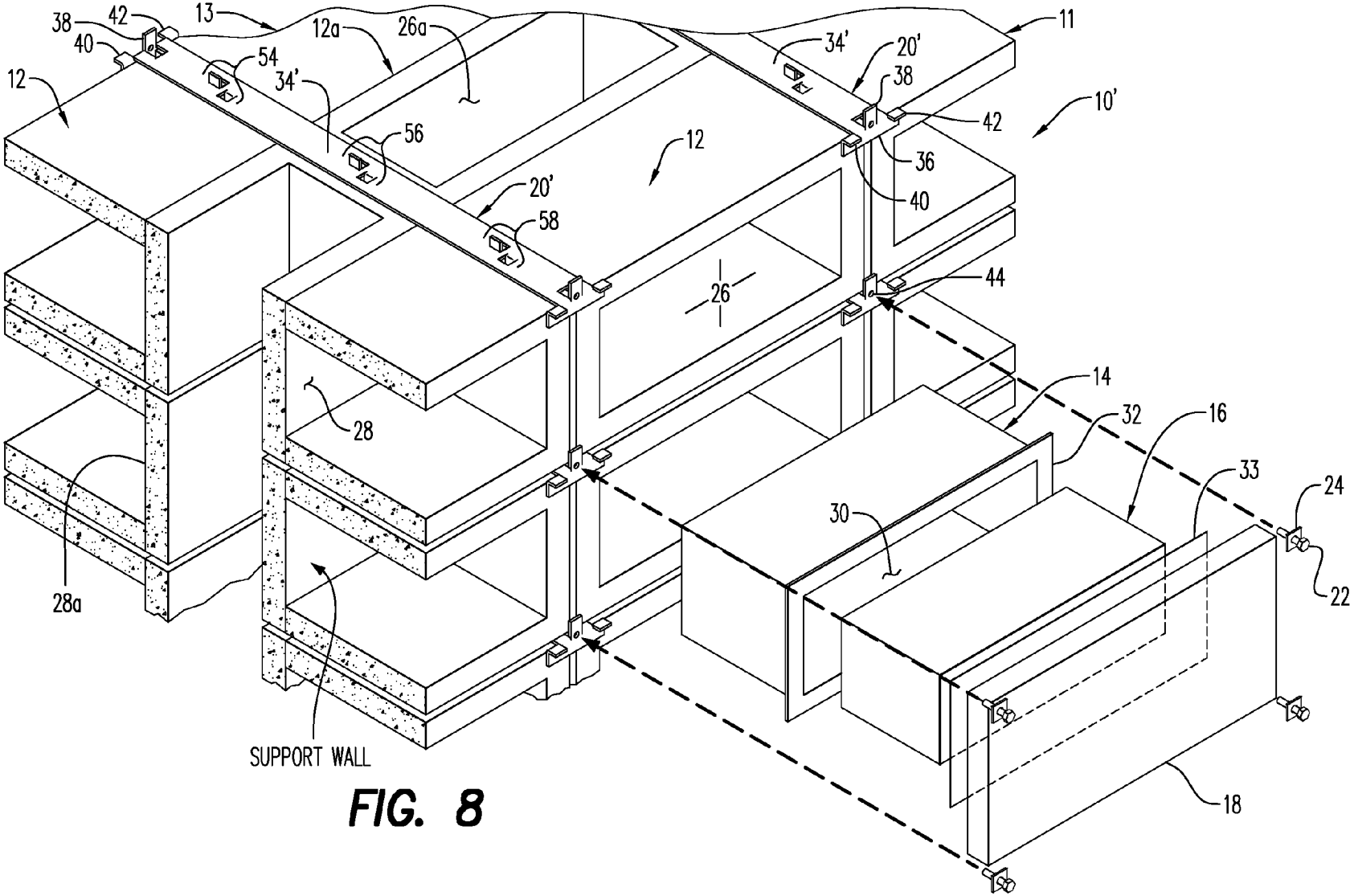
FIG. 8 is an exploded perspective view of a double-banked cremation niche system.
Figure 9:
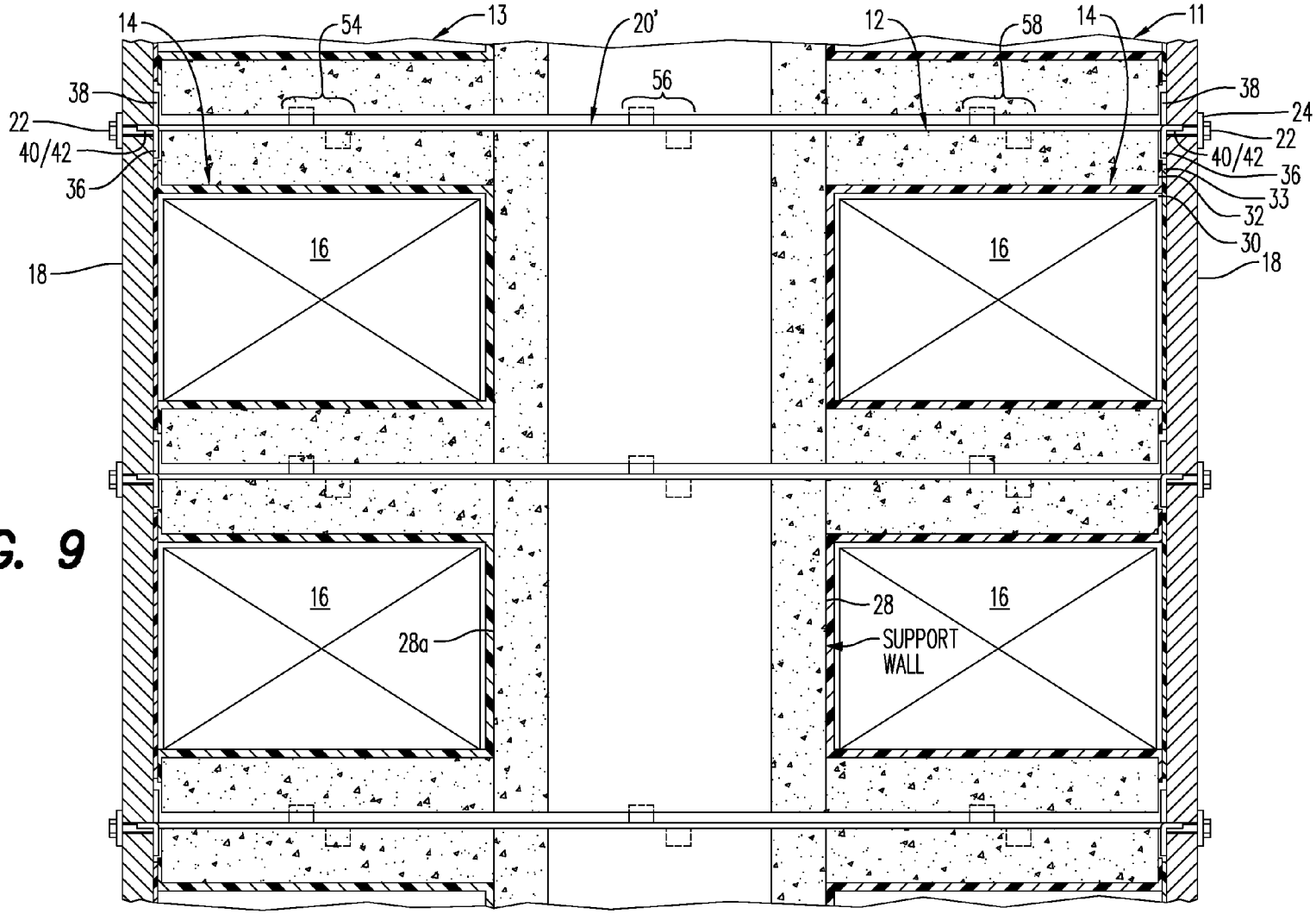
FIG. 9 is a vertical section view of FIG. 8.
Figure 10:
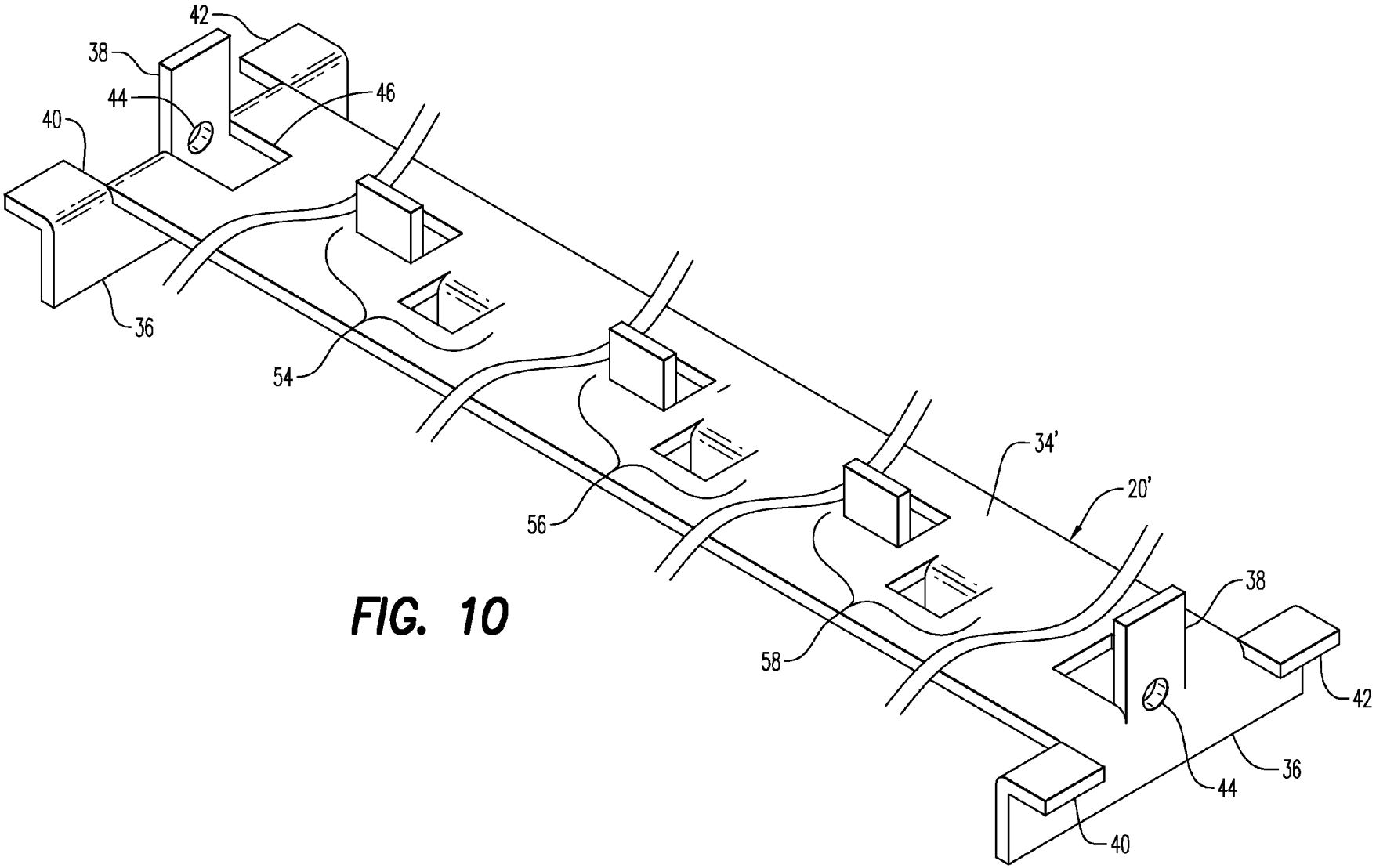
FIG. 10 is a perspective view of a double-ended faceplate support strap used in the embodiment in FIG. 8.
Figure 11:
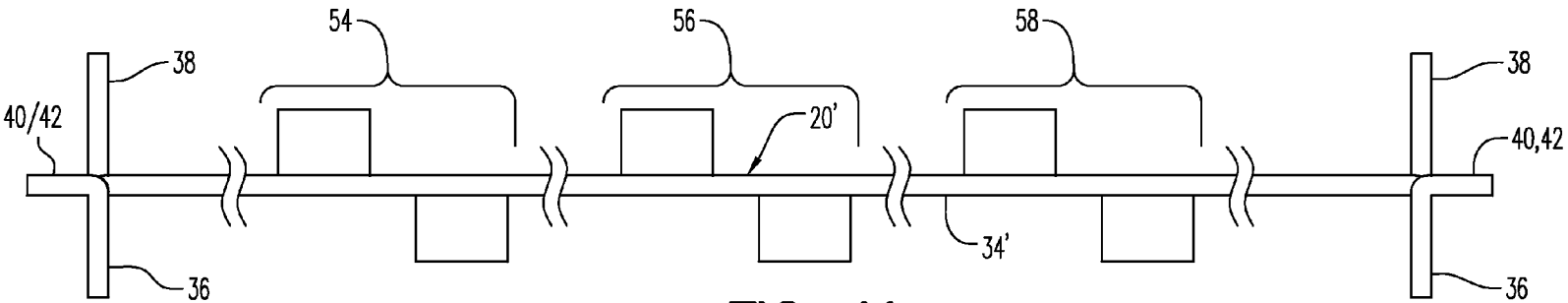
FIG. 11 is a side elevation view of FIG. 10.
Figure 12:
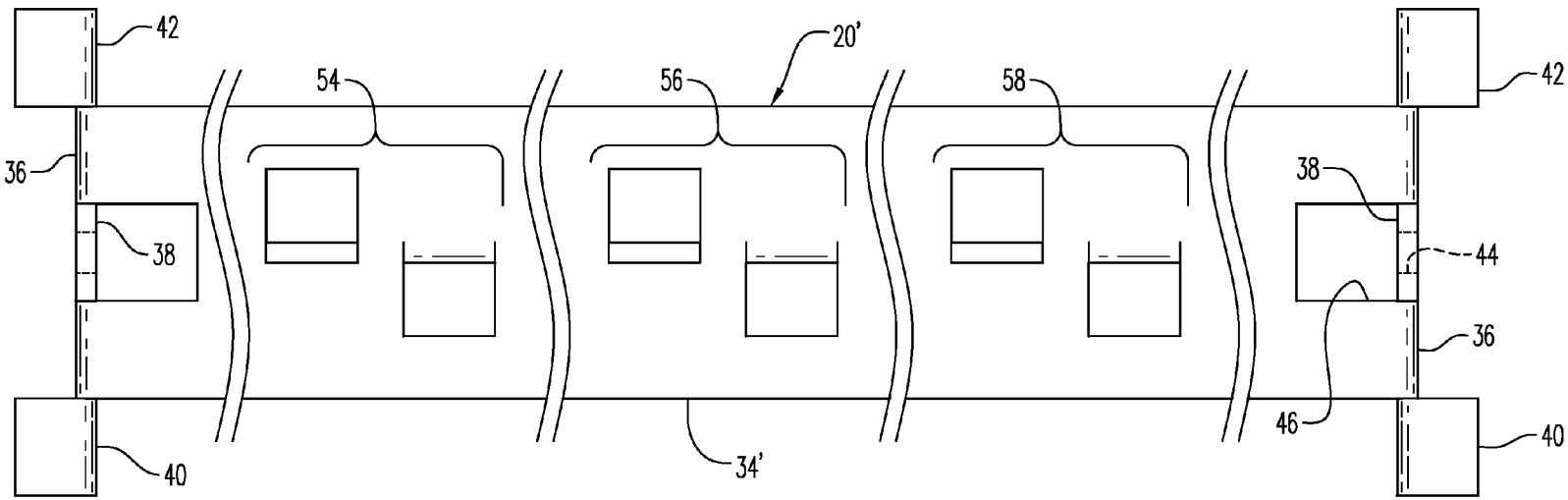
FIG. 12 is a top plan view of FIG. 10.

To vertically and horizontally space each side-by-side and stacked blocks, and to horizontally align each block of concrete blocks 12, an elongated faceplate support strap 20' is provided. This support strap 20' has a first end with structural features at 36, 38, 40, 42, and 44 as previously described. However, the flat bar 34' is elongated to span three concrete block widths, or approximately 24" and includes a second end which is configured identically to that of the first end such that, as best seen in FIGS. 8 and 9, upright stops 36 and 38, being symmetric end to end, hold the concrete blocks 12 and 12*a* together and tightly against the upright wall surfaces 28 and 28*a* of the support wall. The block alignment tab pairs 54 and 58 properly space apart and align adjacent pairs of concrete blocks 12, while the block alignment tab pair 56 aligns and properly spaces apart the concrete block 12*a* forming the support wall. Each end of this double faceplate support strap 20' includes the faceplate supports 40 and 42 as previously described. Again, all of these concrete blocks 12 and 12*a* are identical and have dimensional identity width conventional concrete blocks as previously described. Each end of this double faceplate support strap 20' includes the faceplate supports 40 and 42 as previously described.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A cremation niche used in constructing a single or a double bank crematory niche system comprising:

a concrete masonry block formed as a single unit having an uninterrupted cross section which includes rectangular sides, top and bottom panels and open rectangular front and rear openings thereof, said front opening providing access into a hollow horizontally disposed open-ended interior of said concrete block;

said concrete block having material consistency;

a liner snugly fit within and mating against each interior walls which define said interior;

a rigid rectangular decorative faceplate attachable to, and covering said front opening and an open perimeter of said liner;

an elongated flat faceplate support strap positionable between a plurality of vertically stacked and horizontally aligned said concrete blocks which form each of the banks, said support strap sized in thickness to establish vertical spacing between adjacent stacked rows of said concrete blocks;

an end of said support strap including an upright stop and a faceplate support for supporting said faceplate and vertically aligning each of said concrete blocks of the bank stacked one concrete block atop another;

a mid-portion of said support strap also including upright alignment tabs for horizontally aligning and spacing side-by-side concrete blocks forming each row of a single bank crematory niche system.

2. A cremation niche as set forth in claim 1, wherein:

another end of said support includes a second upright stop and a second faceplate support for supporting another said faceplate and vertically aligning each of said concrete blocks of a second bank stacked one concrete block atop another forming a double bank crematory niche system.

3. A cremation niche as set forth in claim 2, further comprising:

a cover plate positioned between said perimeter and said faceplate for protectively sealing cremated remains placed into said liner.

4. A cremation niche as set forth in claim 3, further comprising:

threaded fasteners each including a decorative rosette for attaching each corner of said faceplate.

* * * * *